United States Patent [19]

Parodi

[11] 4,129,961

[45] Dec. 19, 1978

[54] SPINNING TOP AND BELT

[76] Inventor: Arnold E. Parodi, 1950 NW. 85th Way, Pembroke Pines, Fla. 33024

[21] Appl. No.: 804,503

[22] Filed: Jun. 8, 1977

[51] Int. Cl.[2] ..... A63H 1/00

[52] U.S. Cl. ..... 46/64; 46/72

[58] Field of Search ..... 46/64, 70, 71, 72, 73

[56] References Cited

U.S. PATENT DOCUMENTS

| | | | |
|---|---|---|---|
| 468,233 | 2/1892 | Boldeck | 46/72 |
| 999,839 | 8/1911 | Myers | 46/72 |
| 1,171,196 | 2/1916 | Handell | 46/72 X |
| 1,261,854 | 4/1918 | Reynders | 46/64 |
| 1,366,535 | 1/1920 | Harrington | 46/72 X |
| 2,069,373 | 2/1937 | Kraft | 46/64 |

FOREIGN PATENT DOCUMENTS

| | | | |
|---|---|---|---|
| 17454 | 3/1882 | Fed. Rep. of Germany | 46/71 |
| 83831 | 9/1956 | Netherlands | 46/73 |
| 192019 | 1/1923 | United Kingdom | 46/64 |

*Primary Examiner*—Louis G. Mancene

*Assistant Examiner*—Mickey Yu

[57] ABSTRACT

This is a spinning top formed in one piece of suitable material having a proper weight, such as wood or high impact plastic material. It has a bottom convex spinning surface merging into an outwardly upwardly extending cone-shaped portion. The cone-shaped portion then merges into an upwardly extending cylindrical main body portion, which, in turn, merges smoothly outwardly and upwardly into a second cylindrical portion. This second cylindrical portion is internally hollow and cylindrical and merges inwardly into a hollow area within said main body cylindrical portion, this hollow portion with said main body cylindrical portion being slightly tapered downwardly and inwardly and serves to receive a rod or the human thumb of one hand while the other hand manipulates a flexible belt or strap of suitable length about the main body cylindrical portion to impart spinning rotation to the spinning top, this flexible belt or strap having a width about equal to the external height of the main body cylindrical portion.

3 Claims, 5 Drawing Figures

SPINNING TOP AND BELT

OBJECTS OF THIS INVENTION

It is an object of this invention to provide a suitable and challenging toy for adults as well as children.

A further object of this invention is to provide a spinning top in combination with a flexible belt or strap of suitable width and length for imparting spinning motion to the spinning top, as well as for manipulating the belt or strap to repeatedly impart spinning motion to the top as long as desired.

A further object of this invention is to provide a onepiece spinning top which may be carved out of wood or molded out of suitable high impact plastic, and may be single or multiply colored as desired.

Yet a further object of this invention is to provide a one-piece top in combination with a flexible belt or strap for manually imparting spinning motion to the top and for adding spinning motion from time to time as desired.

A still further object of this invention is to provide a spinning top that has a cylindrical main body portion and a top spinning flexible belt or strap having a width about the height of the main body portion.

A yet further object of this invention is to provide a combination of a spinning top and a flexible fabric belt or strap, the spinning top having a main body cylindrical portion above a cone-shaped depending portion having a spinning surface on its bottom, the belt or strap having a width about the height of the main body cylindrical portion.

A further object of this invention is to provide a spinning top that is hollow and open at its upper end for receiving a rod or human thumb therein, the spinning top having a cylindrical main body portion for receiving a flexible belt or strap about the top portion to impart spinning motion thereto.

Yet a still further object of this invention is to provide a spinning top that has a convex spinning surface at the bottom of an outwardly upwardly extending cone-shaped portion which merges into an upwardly extending main body portion, in turn merging into a second cylindrical portion that is internally hollow and merges into a hollow area within the main body cylindrical portion, this main body hollow area being slightly tapered to receive a rod or human thumb while manually manipulating a flexible belt or strap wrapped about the main body portion to provide spinning motion to the top in either direction.

A further object of this invention is to provide a top that is an improvement over prior tops, including that shown in U.S. Pat. No. 3,352,055, amongst others.

BRIEF DESCRIPTION OF THE FIGURES

With the above and related objects in view, this invention consits in the details of construction and combination of parts, as will be more fully understood from the following description, when read in conjunction with the accompanying drawing, in which.

DETAILED DESCRIPTION OF THE INVENTION

Figure 1:
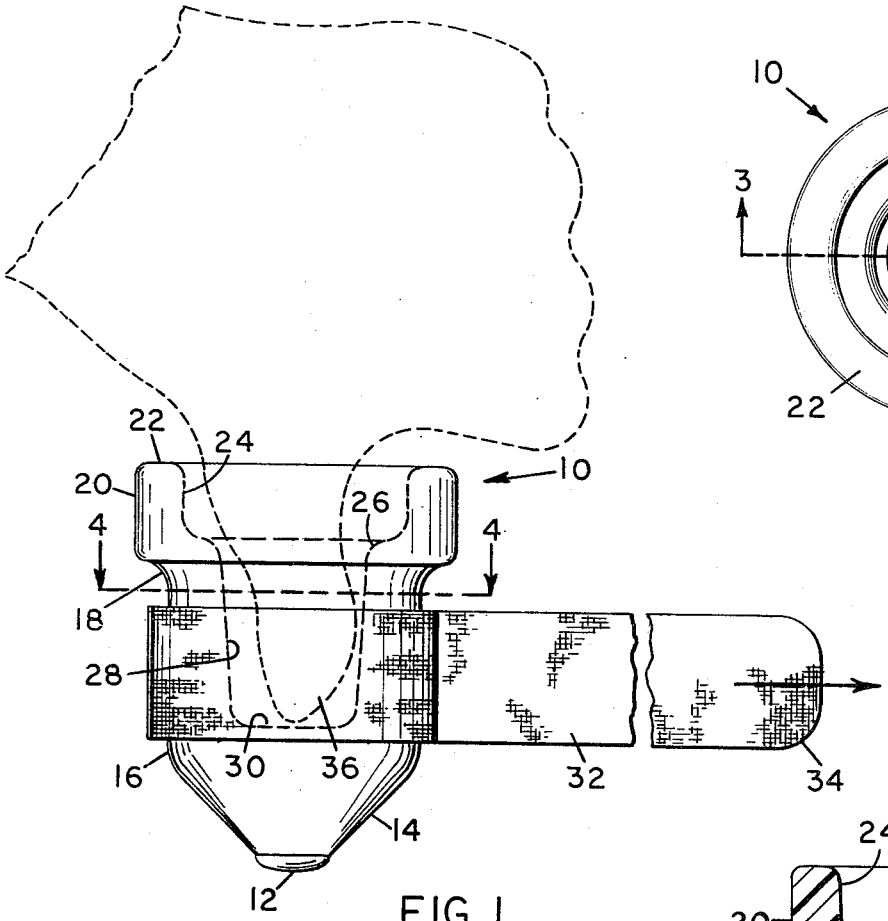
FIG. 1 is an elevation view, partly in phantom, showing the spinning top and the spin imparting flexible belt or strap wound about the top, with a human thumb held in the hollow upper portion of the top.
Figure 2:
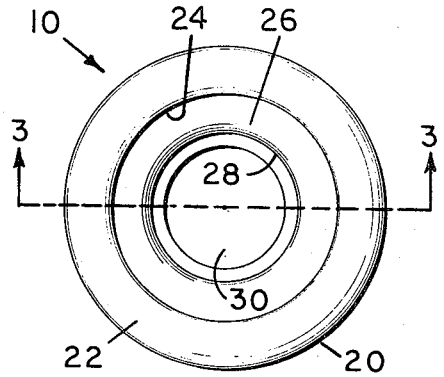
FIG. 2 is a top plan view of the spinning top of FIG. 1.
Figure 3:
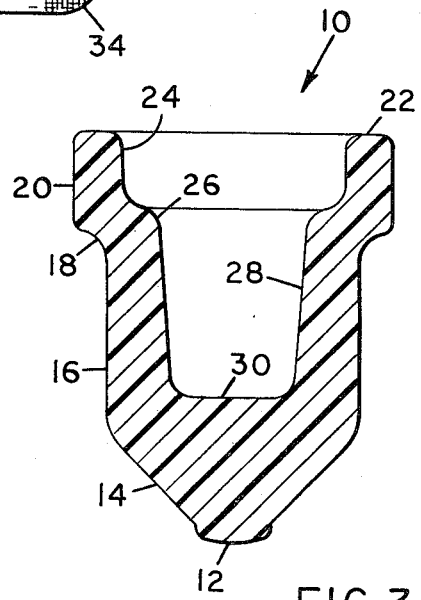
FIG. 3 is a section on line 3—3 of FIG. 2.

There is shown at 10 the spinning top of this invention. This top 10 has a convex spinning surface 12 at its bottom. This convex spinning surface 12, shaped somewhat like a button, merges into an outwardly upwardly flaring cone-shaped portion 14 which merges into a main body cylindrical portion 16. Therefore, as used hereinafter, the term "convex spinning bottom surface" shall mean a discoid or button-like spinning surface being only slightly convex relative to a flat surface upon which the top may be spinned to thereby provide an arcuate or bow like top spinning and rocking surface. This main body portion 16 at its upper end merges outwardly and upwardly at 18 feathering into a second upwardly extending cylindrical portion 20.

This cylindrical portion 20 curves smoothly into a flat upper area 22 that curves smoothly into a somewhat vertical inner wall 24. This inner wall 24, about coextensive with the second cylindrical portion 20, in turn merges smoothly at 26 into an inwardly tapered hollow wall 28 terminating smoothly into a bottom wall 30.

Figure 4:
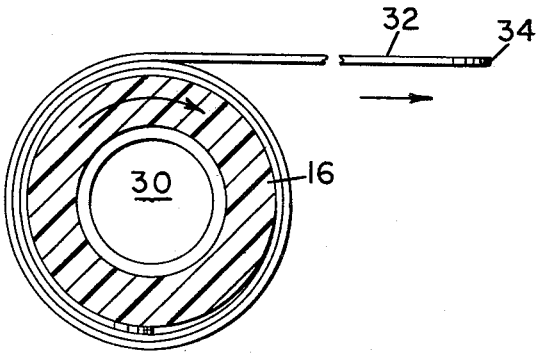
FIG. 4 is a section on line 4—4 of FIG. 1, the spin imparting flexible strap being wound for clockwise rotation.
Figure 5:
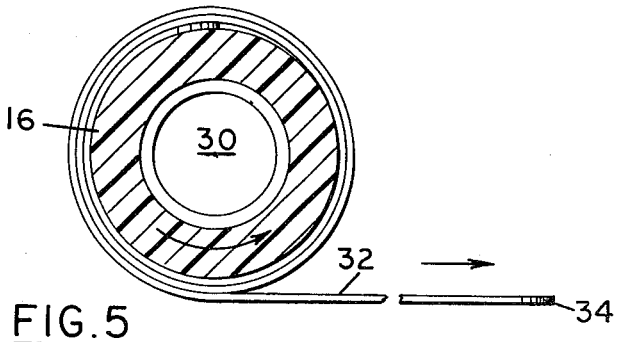
FIG. 5 is a similar section for counter-clockwise rotation.

A flat, flexible belt or strap 32, of suitable length, made of siliconed fabric, is of a width about the height of the cylindrical main body 16 about which it may be wrapped for providing a spinning motion to the top 10, in either a clockwise direction, as in FIG. 4, or counter-clockwise, as in FIG. 5. The belt or strap has somewhat curved ends 34.

OPERATION OF THE INVENTION

To spin the top 10, a rod or the human thumb 36 is extended as an axle into the inner hollow portion of the top 10, as shown in FIG. 1, and the belt or strap 32 is wrapped about the cylindrical main body 16, as in FIGS. 1 and 4, the width of the belt 32 being about the height of the body 16, as shown. Then, making a quick pull on the belt 32 will cause the spinning top 10 to start spinning, supported on any suitable floor or surface on the spinning button 12. The speed of rotation of the spinning top 10 can be increased by folding the belt 32 in half lengthwise to increase its whipping power and whipping the folded belt 32 about the spinning top 10. The direction of rotation of the top 10 can be reversed while spinning by loosely wrapping the belt 32 about the top 10 in the opposite direction as in FIG. 5 with the rod or thumb inserted in the top 10 and giving the belt 32 a strong, quick pull.

If desired, after the top is spinning fast enough, holding the belt taut in two hands, the belt may be slipped under the spinning surface 12 and the rotating top may be snapped vertically into the air and then it will drop onto a floor or other surface to continue rotating on its spinning button 12.

ABSTRACT OF THE DRAWING

In the drawing, like numbers refer to like parts, and for the purposes of explication, marshalled below are the numbered parts of the improved SPINNING TOP AND BELT of this invention:

10 spinning top

12 spinning surface at bottom

14 cone-shaped portion above 12
16 main body cylindrical portion
18 curved portion connecting 16 to 20
20 second upper cylindrical portion
22 flat top edge of 20
24 inner cylindrical wall of 22
26 smooth curved surface connecting 24 to 28
28 slightly tapered inner surface of 16
30 bottom of inner hollow
32 belt or strap for imparting spinning motion
34 somewhat curved ends of 32
36 human thumb Although the invention has been described in considerable detail, such description is intended as being illustrative rather than limiting, since the SPINNING TOP AND BELT of this invention may be variously embodied, and the scope of this invention is to be determined as claimed.

Having thus set forth and disclosed the nature of this invention, what is claimed is:

1. A spinning top and flat flexible belt in combination comprising:

a spinning top comprising a cone-shaped bottom surface merging into a top convex spinning bottom surface, said cone-shaped bottom surface merging into an upwardly extending cylindrical main body portion having a first outer circumference, then merging outwardly and upwardly into a second cylindrical area having a second outer circumference with a radius less than twice the radius of said first outer circumference, said second cylindrical area having inner wall portions approximately coextensive with said second cylindrical area defining a first hollow cylindrical interior having a circumference merging internally into a second hollow interior area being slightly tapered inwardly and having a circumference less than said circumference of said first hollow cylindrical interior and being disposed within the main body cylindrical portion, said first and second hollow interior areas being contoured to receive therewithin a rod or a human finger; and a flat flexible belt means having a width approximately the height of said main body cylindrical portion for being overlappingly wrapped around the main body cylindrical portion and pulling to provide rotation to the spinning top.

2. A top and flexible belt as in claim 1, wherein: the flexible belt is a silicone fabric belt.

3. A top and flat flexible belt as in claim 1, wherein: said belt means being also loosely wrapped in a direction for being disposed about said top while said top is spinning for being pulled to reverse the rotation of the spinning top.

* * * * *